US007422303B2

(12) United States Patent
Kobayashi et al.

(10) Patent No.: US 7,422,303 B2
(45) Date of Patent: Sep. 9, 2008

(54) INKJET COATING METHOD AND APPARATUS

(75) Inventors: Shinya Kobayashi, Hitachinaka (JP); Takahiro Yamada, Hitachinaka (JP); Hitoshi Kida, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 496 days.

(21) Appl. No.: 11/069,943

(22) Filed: Mar. 3, 2005

(65) Prior Publication Data

US 2005/0243112 A1 Nov. 3, 2005

(30) Foreign Application Priority Data

Mar. 4, 2004 (JP) ..... 2004-060398

(51) Int. Cl.
*B41J 29/393* (2006.01)

(52) U.S. Cl. ..... 347/19; 347/5; 347/17

(58) Field of Classification Search ..... 347/19, 347/17, 5

See application file for complete search history.

(56) References Cited

U.S. PATENT DOCUMENTS 6,406,115 B2 * 6/2002 Mantell et al. ..... 347/15
6,433,889 B1 * 8/2002 Tanabe ..... 358/1.9
6,554,398 B2 * 4/2003 Wyngaert et al. ..... 347/42
2003/0001914 A1 * 1/2003 Matsumoto et al. ..... 347/12
2004/0036731 A1 * 2/2004 Ready et al. ..... 347/19

FOREIGN PATENT DOCUMENTS

JP 5-278221 10/1993
JP 05278221 A * 10/1993
JP 9-11457 1/1997
JP 2000-353594 12/2000

* cited by examiner

*Primary Examiner*—Manish S. Shah
*Assistant Examiner*—Laura E Martin
(74) *Attorney, Agent, or Firm*—Whitham Curtis Christofferson & Cook PC

(57) ABSTRACT

An inkjet coating method can achieve high-performance coating with a simple system by forming a precise and uniform coat over a coating area and precise edge parts on the periphery of the coating area. The inkjet coating method, firstly, extracts an edge image and an internal image from coating image. Next, the inkjet coating method forms the edge image including a plurality of edge image portions each extending to different directions, while forming each edge image portion by a single nozzle. And then, the inkjet coating method forms the internal image using a leveling technique.

24 Claims, 10 Drawing Sheets

INKJET COATING METHOD AND APPARATUS

BACKGROUND OF THE INVENTION

1. Field of the Invention

The present invention relates to an inkjet coating apparatus, and particularly to an on-demand inkjet coating method and apparatus suitable.

2. Description of the Related Art

A multi-nozzle inkjet coating apparatus can apply ink rapidly and densely over a workpiece (substrate) using an on-demand coating head that includes a dense arrangement of several hundred to several thousand nozzles. However, since the weight and ejection position of the ink droplets varies from nozzle to nozzle, this conventional multi-nozzle inkjet coating apparatus cannot form an even coating with precision and edges with sufficient precision.

The technology disclosed in Japanese unexamined patent application publication No. HEI-9-11457 achieves a uniform weight in ink droplets by fine-tuning individual drive voltage waveforms impressed on the piezoelectric elements and heating elements of each nozzle. However, while this technology can suppress variations in droplet weight, it has difficulty suppressing variations in ejection position and hence, the coating precision remains insufficient. Further, the technology cannot form edges with precision.

A leveling technology well known in the art can achieve a uniform expansion of ink droplets on the substrate by adjusting the viscosity of the ink and the angle at which the ink droplets contact the substrate. This technology can average variations in the weight and ejection position of ink droplets, thereby forming a uniform coating with precision. However, this precision drops when coating such detailed areas as edges. For example, ink droplets to form sharp corner will expand to form a rounded corner.

To overcome this problem, Japan unexamined patent application publication No. 2000-353594 proposes to control the direction of ink spreading by forming a banks at outer of edges with polyimide or the like and treating the surface of the bank to repel ink. With this method, edges can be formed with precision.

However, the method disclosed in Japan unexamined patent application publication No. 2000-353594 is generally complex and, therefore, the simplistic feature of the inkjet coating apparatus is lost. Moreover, the method is less cost-effective.

Further, a technology is disclosed in Japanese unexamined patent application publication No. HEI-5-278221 for increasing the optical density of edge parts at which ink droplets penetrate paper to form sharper images by ejecting ink droplets of a larger volume in the edge parts of an image and a smaller volume in non-edge parts.

However, Japanese unexamined patent application publication No HEI-5-278221 uses a plurality of nozzles to eject ink droplets in edge parts. Although this is not a problem if the nozzles precision is high, sharp edge parts cannot be formed if this precision is low. For example, when forming a side corresponding to an edge part if the precision of each nozzle is poor, the result will be a jagged side which is formed the plurality of nozzles.

SUMMARY OF THE INVENTION

In view of the foregoing, it is an object of the present invention to provide an inkjet coating method and apparatus capable of achieving high-performance coating with a simple system by forming a precise and uniform coat over a coating area and precise edge parts on the periphery of the coating area.

In order to attain the above and other objects, the present invention provides an inkjet coating method for forming a coating image on a substrate by ejecting ink droplets from a plurality of nozzles formed in a head comprising an extracting step, an edge image forming step, and an internal image forming step. The head has a head-surface on which the plurality of nozzles are exposed. The substrate has a substrate-surface onto which the ink droplets are ejected. The head-surface is oriented parallel to the substrate-surface. The coating image is formed, while moving either the substrate or the head, or both, in a moving-direction and placing the head-surface and the substrate-surface in confronting relation. The coating image is formed from an edge image defining an outline of the coating image, and an internal image within the edge image.

The extracting step extracts edge image data indicative of the edge image from image data indicative the coating image. The edge image forming step that, after executing the extracting step, forms the edge image based on the edge image data. The edge image forming step includes step of forming an edge image portion extending in the moving-direction by continuously ejecting the ink droplets from a single nozzle onto the substrate, while moving either the substrate or the head, or both, in the moving-direction. The internal image forming step, after executing the edge image forming step, forms the internal image onto the substrate.

It is preferable that the edge image data includes a plurality of pieces of edge portion image data each indicative of each of the plurality of edge image portions making up the edge image, and the extracting step extracts, from the image data, the plurality of piece of edge portion image data.

It is preferable that the edge image forming step comprises a step of forming the plurality of edge portion images extending to a same direction.

It is preferable that the inkjet coating method further comprises a direction adjusting step. The direction adjusting step, after executing the extracting step and before executing the edge image forming step, adjusts a direction to which an edge image portion extends so as to be in coincidence with the moving-direction, while rotating either the substrate or the head in a rotating-plane oriented parallel to the head-surface and the substrate-surface.

It is preferable that the internal image forming step comprises a step of forming the internal image after forming the edge image by executing the direction adjusting step and the edge image forming step with respect to all the edge portion images.

It is preferable that the inkjet coating method further comprises a nozzle adjusting step. The nozzle adjusting step, after executing the extracting step and before executing the edge image forming step, adjusts a position of the single nozzle so that the ink droplets ejected from the single nozzle forms the edge portion image.

It is preferable that the inkjet coating method further comprises a direction adjusting step and a nozzle adjusting step. The direction adjusting step that, after executing the extracting step and before executing the edge image forming step, adjusts a direction to which an edge image portion extends so as to be in coincidence with the moving-direction, while rotating only the substrate in a rotating-plane oriented parallel to the head-surface and the substrate-surface. The nozzle adjusting step that, after executing the executing the extracting step and before executing the edge image forming step, adjusts a position of the single nozzle so that the ink droplets ejected from the single nozzle forms the edge portion image, while either rotating the head in the rotating-plane or moving the head, or both.

It is preferable that the head has a plurality of nozzle modules each including the plurality of the nozzles, and the nozzle adjusting step adjusts the position of the single nozzle, while either rotating the head in the rotating-plane or moving the plurality of the nozzle modules.

It is preferable that the head has a plurality of nozzle modules each including the plurality of the nozzles, and the nozzle adjusting step comprises a step of adjusting the position of the single nozzle, while either rotating the head in the rotating-plane or moving the plurality of the nozzle modules.

It is preferable that the nozzle adjusting step comprises a step of adjusting the plurality of nozzle modules so that all the nozzle in the plurality of the nozzle modules align at an equi-interval as viewed from the moving-direction.

It is preferable that the internal image forming step comprises a step of forming the internal image after the edge image formed with the ink droplets have dried.

It is preferable that the internal image forming step comprises a step of ejecting the ink droplets at an equi-interval so that the ink droplets expand on the substrate and blend with each other.

It is preferable that an amount for each ink droplet forming the edge Image is smaller than an amount for each ink droplet forming the internal image.

It is preferable that the ink droplets for forming the edge image are ejected at an equi-interval which is smaller than an equi-interval of the ink droplets ejected for forming the internal image.

According to another aspect, the present invention provides an inkjet coating apparatus comprising a head, a substrate, a moving unit, an extracting unit, an edge image forming unit, and an internal image forming unit.

The head has a head-surface on which a plurality of nozzles are exposed. The substrate includes a substrate-surface onto which ink droplets are ejected. The head-surface is oriented parallel to the substrate-surface. The coating image is formed from an edge image defining an outline of the coating image, and an internal image within the edge image. The moving unit moves either the head or the substrate, or both, in a moving-direction and placing the head-surface and the substrate-surface in confronting relation. The extracting unit extracts edge image data indicative of the edge image from image data indicative of the coating image. The edge image forming unit forms the edge image including an edge image portion extending in the moving-direction by continuously ejecting the ink droplets from a single nozzle onto the substrate, while moving either the substrate or the head, or both, in the moving direction. The internal image forming unit forms the internal image onto the substrate.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE PREFERRED EMBODIMENTS

An inkjet coater according to preferred embodiments or the present invention will be described while referring to the accompanying drawings. First, an inkjet coater 1 according to a first embodiment will be described with reference to FIGS. 1 through 10.

Figure 1:
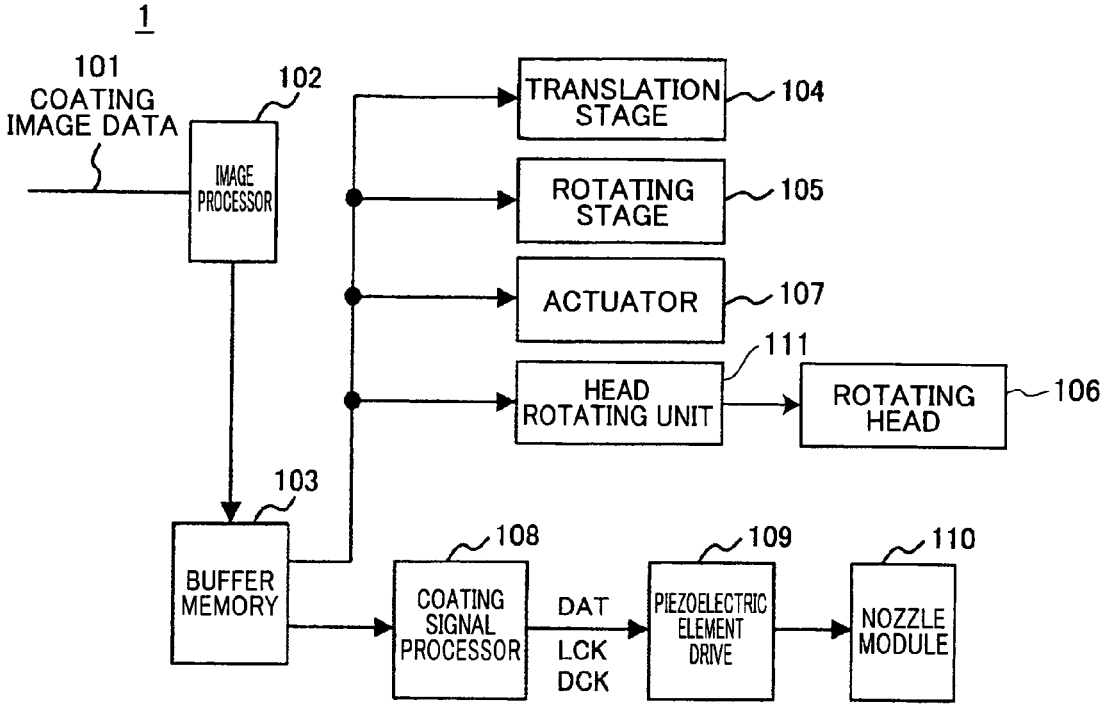
FIG. 1 is a block diagram showing the structure of an inkjet coater according to a first embodiment.

FIG. 1 is a block diagram showing the overall construction of the inkjet coater 1 according to the first embodiment. As shown in the drawing, the inkjet coater 1 includes an image processor 102, a buffer memory 103, a translation stage 104, a rotating stage 105, a rotating head 106, actuators 107, a coating signal processor 108, a piezoelectric element driver 109, nozzle modules 110, and a head rotating unit 111.

As will be described later, the image processor 102 forms hardware control data and a digital coating signal DAT for each ejection from coating image data 101. The coating image data 101 describes a desired coating image created by the user and is normally binary bitmap data defining the resolution of pixels as black or white. The hardware control data is used to control various hardware equipment, such as the translation stage 104, rotating stage 105, actuators 107, and head rotating unit 111. The digital coating signal DAT determines whether ink is ejected or not ejected from each nozzle.

The buffer memory 103 temporarily stores the hardware control data and the digital coating signal DAT for each ejection created by the image processor 102. At the beginning of the coating process, the buffer memory 103 transmits the hardware control data to the translation stage 104, the rotating stage 105, actuators 107, and head rotating unit 111 and the digital coating signal DAT to the coating signal processor 108.

The coating signal processor 108 outputs the digital coating signal DAT, a data clock DCK, and a latch clock LCK to the piezoelectric element driver 109. The piezoelectric element driver 109 ejects ink from nozzles 200 formed in the nozzle modules 110 based on these signals.

Figure 2:
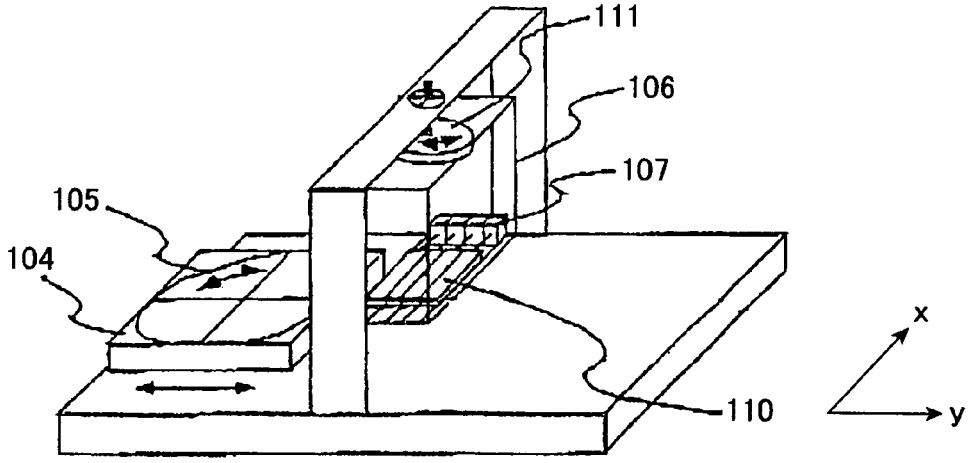
FIG. 2 is a perspective view showing the inkjet coater according to the first embodiment.
Figure 3:
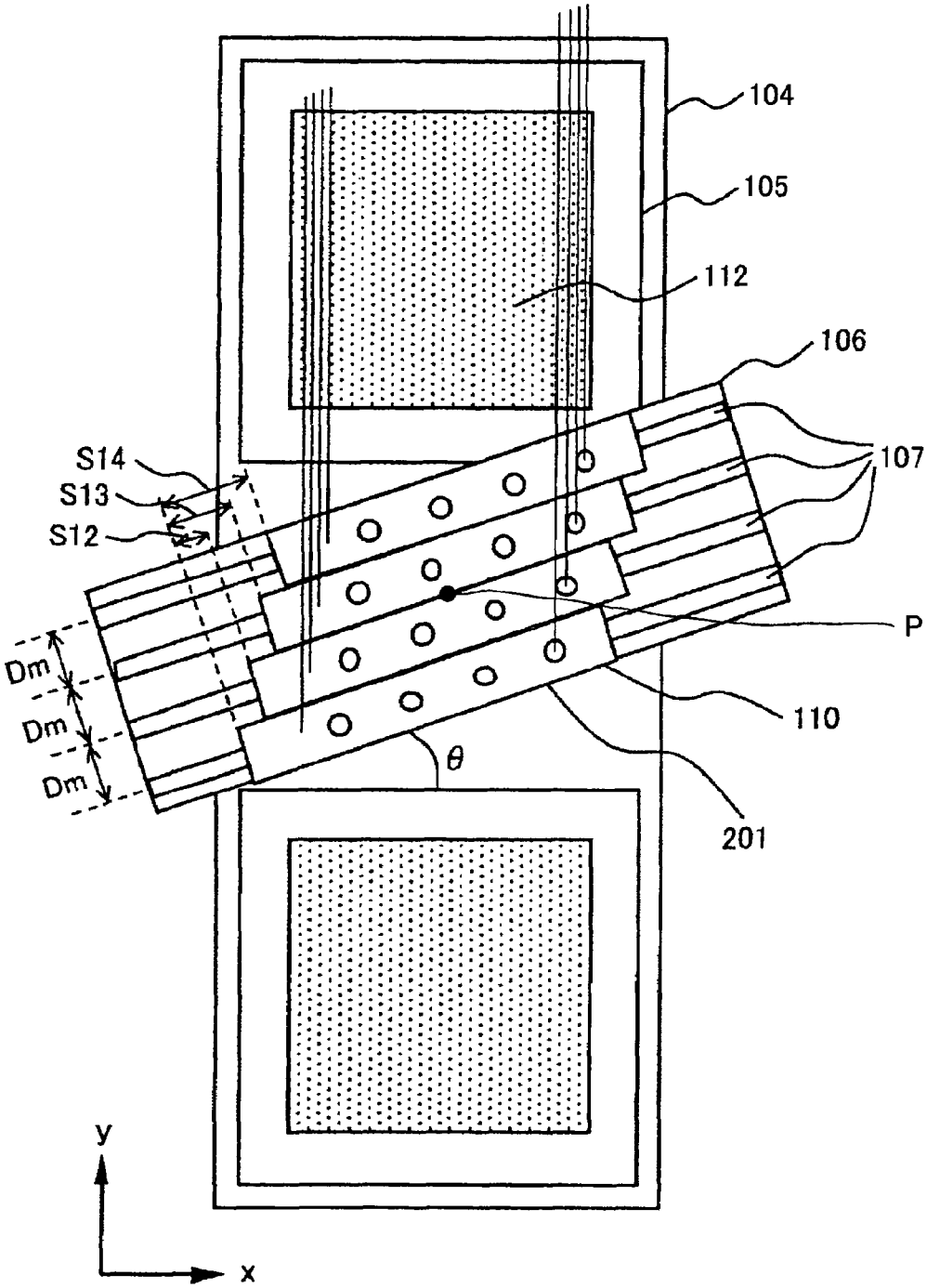
FIG. 3 is a plan view of the inkjet coater according to the first embodiment.

FIG. 2 is a perspective showing the structure of the inkjet coater 1 according to the first embodiment FIG. 3 is a plan view showing the structure of the inkjet coater 1. As described above, the inkjet coater 1 includes the translation stage 104, rotating head 106, and head rotating unit 111.

The translation stage 104 can be moved in a y-direction shown in FIGS. 2 and 3 by a motor (not shown). The rotating stage 105 is mounted on the translation stage 104. A substrate 112 to be coated with ink droplets is held by air suction or the like on top of the rotating stage 105. The rotating stage 105 can rotate the substrate 112 in the x-y plane.

The rotating head 106 functions to eject ink and is disposed in a plane separated 0.5-1.5 mm above the top surface of the substrate 112. The rotating head 106 includes four of the actuators 107 juxtaposed in the y-direction and four of the nozzle modules 110 disposed on the actuators 107. The head rotating unit 111 rotates the rotating head 106 in the x-y plane about a point P shown in FIG. 3.

The actuators 107 function to slide each of the nozzle modules 110 in the longitudinal direction thereof. More specifically, the actuators 107 employ an AC servo linear motor that can slide the nozzle modules 110 at a precision of several microns.

A plurality of nozzle holes 201 is arranged along the longitudinal direction of the nozzle modules 110 at a pitch of 0.5 mm. While the nozzle holes 201 are shown in the nozzle modules 110 in FIG. 3, the nozzle holes are actually pointing downward and cannot be seen.

While not described in the preferred embodiment, the inkjet coater 1 is also provided with an optical microscope measuring device for detecting the position of the rotating stage 105, and an ink supply and maintenance system for the nozzle modules 110.

Figure 4:
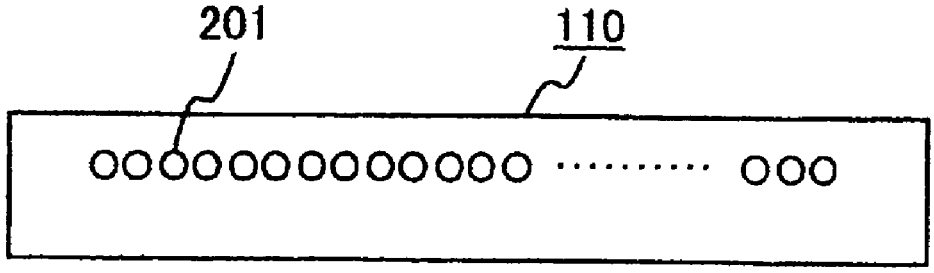
FIG. 4 is an explanatory diagram showing the nozzle layout in the nozzle module.
Figure 5:
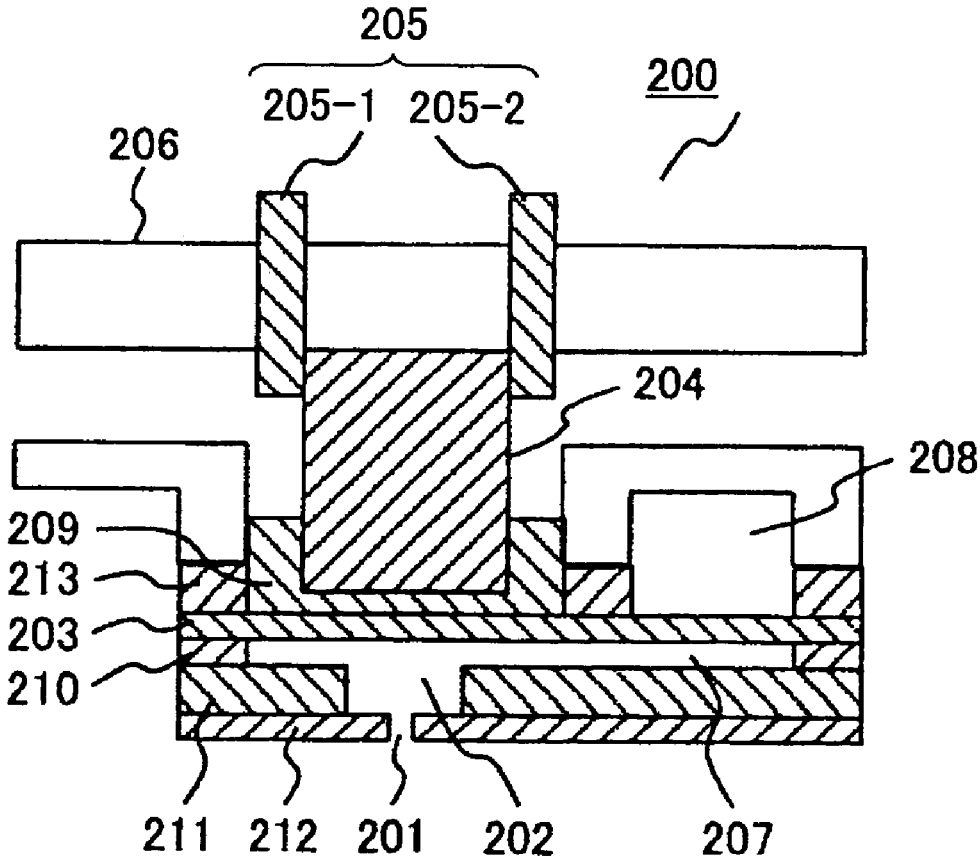
FIG. 5 is a cross-sectional view of a nozzle module employed in the inkjet coater.

FIG. 4 shows the layout of nozzles in the nozzle module 110. A total of 128 nozzle holes 201 are arranged linearly across the nozzle module 110. A nozzle 200 having the construction shown in FIG. 5 is formed linearly inside the nozzle module 110 at a position corresponding to each nozzle hole 201. The pitch of the nozzle holes 201 is 150 nozzles/inch. The nozzle module 110 is connected to the piezoelectric element driver 109.

FIG. 5 is a cross-sectional view showing the construction of the nozzle 200 in the preferred embodiment. Next, the nozzle 200 will be described with reference to FIG. 5. The nozzle 200 is an inkjet nozzle well known in the art that employs a piezoelectric element.

The nozzles 200 includes an orifice plate 212, a pressure chamber plate 211, and a restrictor plate 210. The nozzle hole 201 (orifice) is formed by the orifice plate 212; a pressure chamber 202 is formed by the pressure chamber plate 211; and a restrictor 207 is formed by the restrictor plate 210. A common ink supply channel 208 is also formed in the nozzle 200 for supplying ink to the pressure chamber 202. The restrictor 207 is in communication with the common ink supply channel 208 and pressure chamber 202 and controls the amount of ink flow to the pressure chamber 202.

The nozzle 200 also includes a vibration plate 203, a piezoelectric element 204, a support plate 213, and a piezoelectric element fixing plate 206. The vibration plate 203 and piezoelectric element 204 are coupled by an elastic material 209, such as a silicon adhesive. The piezoelectric element 204 is provided with a common electrode 205-1 and an individual electrode 205-2. A potential difference is generated between the common electrode 205-1 and individual electrode 205-2 when a voltage is applied to the common electrode 205-1, causing the piezoelectric element 204 to expand or contract. The support plate 213 functions to reinforce the vibration plate 203. The piezoelectric element fixing plate 206 fixes the piezoelectric element 204 in place.

The vibration plate 203, restrictor plate 210, pressure chamber plate 211, and support plate 213 are formed of stainless steel; the orifice plate 212 is formed of a nickel material; and the piezoelectric element fixing plate 206 is formed of an insulating material such as a ceramic or polyimide.

With this construction, ink supplied from an ink tank (not shown) is distributed to each restrictor 207 via the common ink supply channel 208 and supplied to the pressure chambers 202 and nozzle holes 201. When a voltage is applied to the common electrode 205-1, the piezoelectric element 204 deforms, causing a portion of the ink in the pressure chamber 202 to eject out through the nozzle hole 201.

Figure 6:
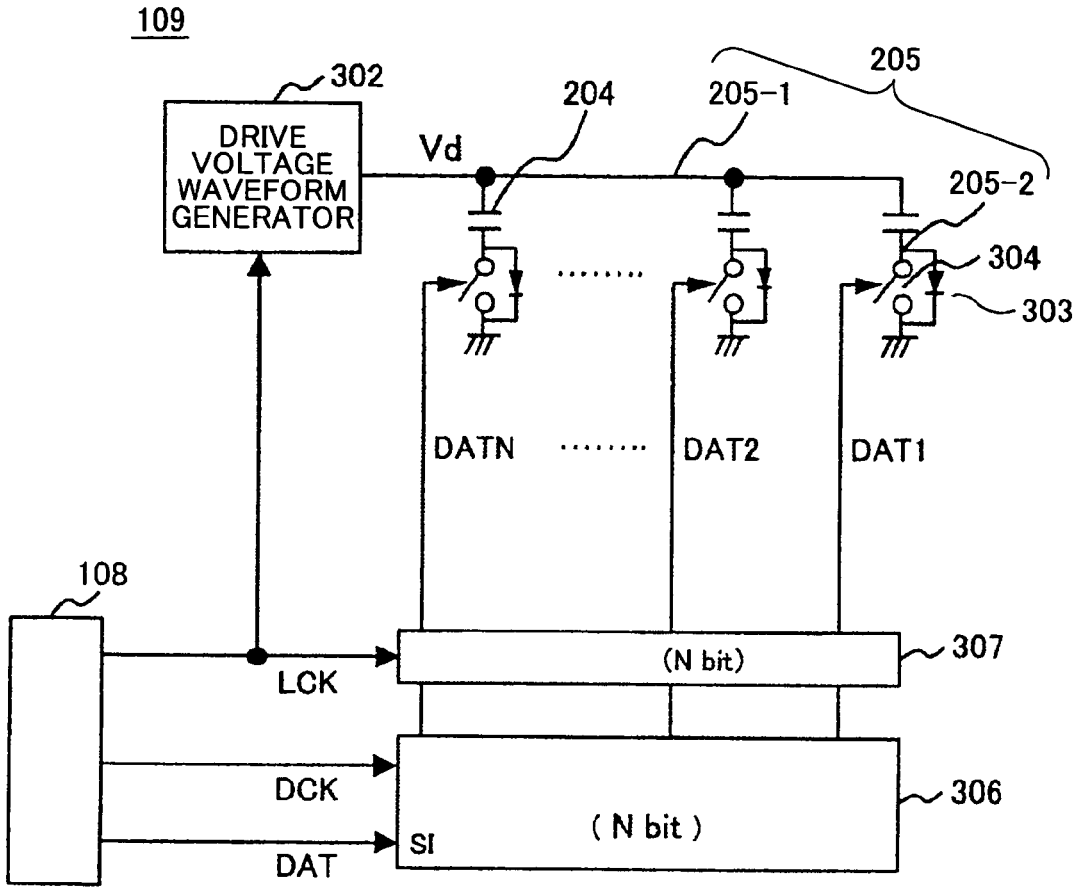
FIG. 6 is a conceptual circuitry diagram of a piezoelectric element driver.

Next, the piezoelectric element driver 109 will be described with reference to FIG. 6. FIG. 6 is a conceptual drawing of the circuitry in the piezoelectric element driver 109. The piezoelectric element driver 109 includes the piezoelectric element 204, a drive voltage waveform generator 302, a switch 304, a shift register 306, and a latch 307. The nozzle 200 shown in FIG. 5 is connected to the piezoelectric element driver 109 via a signal input terminal 205 Specifically, the common electrode 205-1 is connected to the drive voltage waveform generator 302, and the individual electrode 205-2 is connected to the switch 304. For the simplicity of description, the piezoelectric element 204 has been indicated by a symbol resembling a capacitor symbol. In this embodiment, the number of nozzles 200 is N.

The drive voltage waveform generator 302 generates an analog drive voltage Vd. Accordingly, the drive voltage Vd is inputted into the common electrode 205-1. One terminal of the switch 304 is connected to the individual electrode 205-2, while the other is grounded. Accordingly, when the switch 304 is closed, the individual electrode 205-2 is electrically grounded. A diode 303 is also connected in parallel with the switch 304, with the anode being connected to the individual electrode 205-2 side and the cathode being connected to the ground side.

The shift register 306 temporarily stores data inputted from the coating signal processor 108. The latch 307 latches data stored in the shift register 306 in synchronization with the latch clock LCK outputted from the coating signal processor 108.

Next, operations for ejecting ink with the piezoelectric element driver 109 will be described. The piezoelectric element driver 109 initiates an ejection operation when a signal is inputted from the coating signal processor 108. The coating signal processor 108 outputs a digital coating signal DAT and a data clock DCK to the shift register 306.

The data clock DCK is a signal that keeps time used as a reference for all operations of the apparatus. The digital coating signal DAT is N-bit serial data that serves as ejection signals corresponding to ejection signals corresponding to each of the N nozzle holes 201. The digital coating signal DAT is transmitted in the bit order DAT1, DAT2, . . . , and DATN. Accordingly, the DAT1, DAT2, . . . , and DATN are assigned to each nozzle in order from right to left in FIG. 6. In the preferred embodiment, a logical "1" is defined as "ejection," while a logical "0" is defined as "no ejection."

After the N-bits of the digital coating signal DAT have been transferred to the latch 307, the coating signal processor 108 outputs the latch clock LCK to the drive voltage waveform generator 302 and latch 307. The latch clock LCK may also be generated at regular intervals by a timer or the like, or may be generated based on a signal from a sensor (encoder or the like) for detecting the coating position. The latch clock LCK serves not only to direct the latch 307 to latch data stored in the shift register 306, but also as a synchronization signals for the drive voltage waveform generator 302.

Accordingly, the latch 307 latches data stored in the shift register 306 in synchronization with the latch clock LCK, and the drive voltage waveform generator 302 outputs a prescribed drive waveform in synchronization with the latch clock LCK.

Each switch 304 is turned on and off by the corresponding digital coating signal DAT1, DAT2, . . . , and DATN latched by the latch 307. The switch 304 is turned on when the digital coating signal DAT is a logical "1" and off when the digital coating signal DAT is a logical "0". When the switch 304 is turned on, the individual electrode 205-2 is grounded, making the potential difference equivalent to the drive voltage Vd between the common electrode 205-1 and individual electrode 205-2 of the piezoelectric element 204. When a current flows to the piezoelectric element 204, ink is ejected from the nozzle 200. However, if the switch 304 is off, the individual electrode 205-2 is open. As a result, as will be described later in greater detail, a current does not flow to the piezoelectric element 204 and, therefore, ink is not ejected from the nozzle 200.

Figure 7:
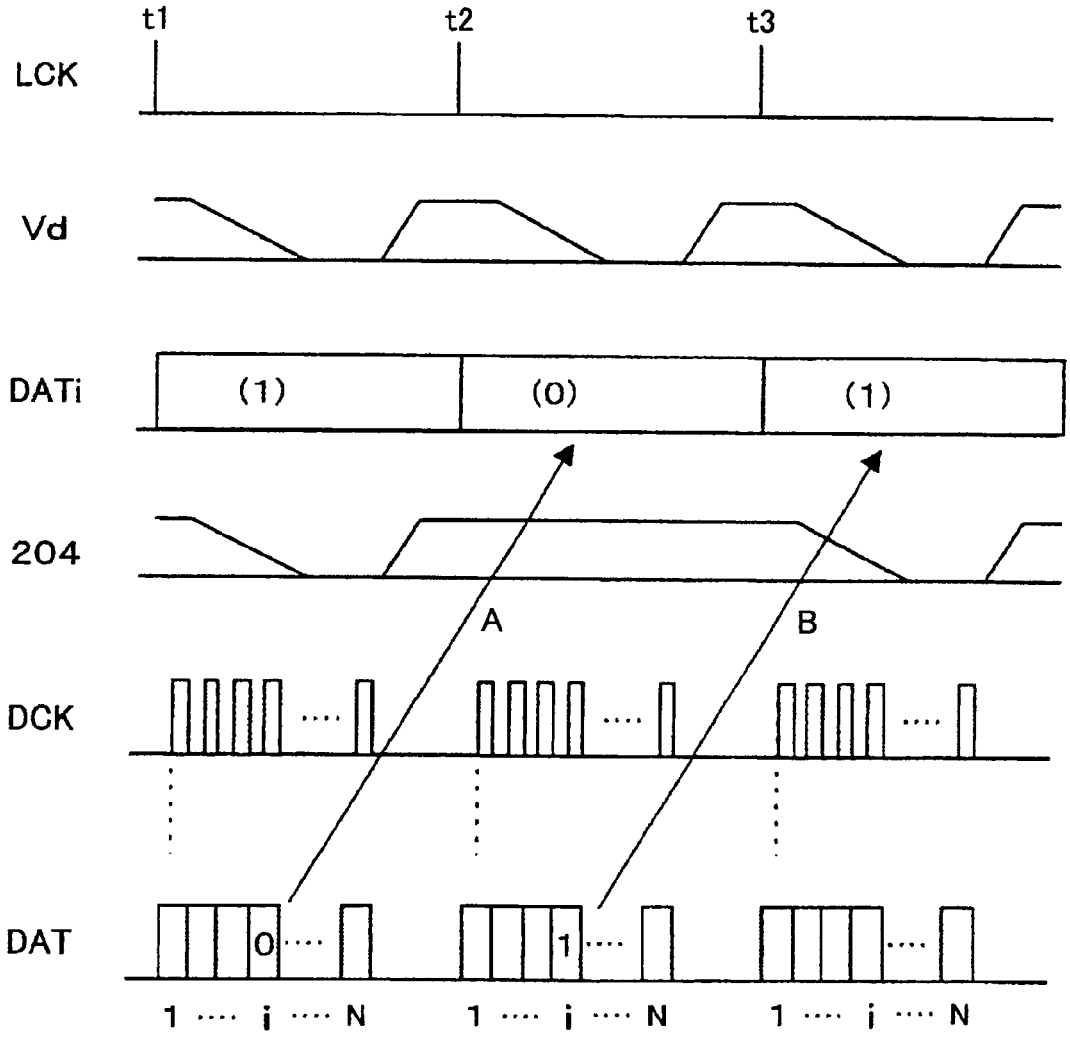
FIG. 7 is a timing chart illustrating the operations of the piezoelectric element drivers.

FIG. 7 is a timing chart illustrating the operations of the piezoelectric element driver 109. Here, the drive voltage Vd has an trapezoid waveform, as shown in the drawing, wherein part of the upper base of the trapezoid waveform is synchronized with the latch clock LCK. A description of the drive voltage waveform generator 302 has been omitted, since the drive voltage waveform generator 302 is well known in the art. Here, a description will be given for the digital coating signal DAT1 for ejecting ink from the $i^{th}$ nozzle 200 from the right of FIG. 6.

When the latch clock LCK is first generated at a timing t1, the latch 307 latches the data (digital coating signal DATi) stored in the shift register 306 in synchronization with the latch clock LCK. At the same times the drive voltage waveform generator 302 generates the drive voltage Vd in synchronization with the latch clock LCK. In this example, we will assume that the latch 307 latches the digital coating signal DATi "l". As described above, the switch 304 is turned on in this case, grounding the individual electrode 205-2 of the piezoelectric element 204. Accordingly, a current flows to the piezoelectric element 204 and ink is ejected from the nozzle 200. After the timing t1, the digital coating signal DAT for the subsequent ejection is inputted in synchronization with the data clock DCK.

When the latch clock LCK is again generated at a timing t2, the latch 307 latches the data that was stored in the shift register 306 between the timings t1 and t2, wherein the digital coating signal DATi is "0" (arrow A). When the digital coating signal DATi ="0", the switch 304 is turned off, opening the individual electrode 205-2. As The individual electrode 205-2 is now open, a current can only flow through the diode 303 connected in parallel to the switch 304. The potential of the individual electrode 205-2, that is, the anode of the diode 303 must be a positive potential for current to flow through the diode 303.

However, the potential of the individual electrode 205-2 is zero when the switch 304 is turned off at the timing t2. On the other hand, the drive voltage Vd at the timing t2 corresponds to the upper base of the trapezoid waveform and cannot reach a higher value. Accordingly, when the drive voltage Vd becomes smaller, the potential of the individual electrode 205-2 becomes negative to maintain the potential difference between the common electrode 205-1 and individual electrode 205-2. When the potential of the individual electrode 205-2, that is, the anode of the diode 303 is negative, a current cannot flow through the diode 303. Hence, a voltage drop due to natural discharge does not occur. In this way, ink is not ejected from the nozzles 200 when the digital coating signal DATi="0".

When the latch clock LCK is again generated at a timing t3, the latch 307 latches the digital coating signal DATi—"1" (arrow B) that was stored in the shift register 306 between the timings t2 and t3, and ink is ejected from the corresponding nozzle 200.

Next, a process for extracting edges performed by the image processor 102 will be described with reference to FIG. 8.

FIG. 8 includes explanatory diagrams illustrating how a coating image obtained from the coating image data 101 is broken down into an internal image and an edge image having a plurality of angles. Here, the outline of the coating image is referred to as the edge image, and all other portions the internal image. The form shown in FIG. 8(A) can be imagined as an Interconnection pattern or the like serving as the coating area of a display substrate or the like. The coating image data 101 is binary bitmap data indicating black or white and has a resolution of 0.1 mm. In other words, pixels represented by small grids in the drawings are 0.1 mm in size, horizontally and vertically.

Figure 8A:
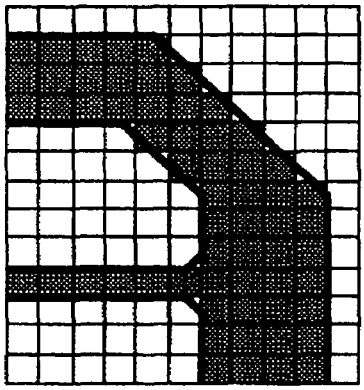
FIG. 8(A) is an explanatory diagram illustrating an interconnection pattern.
Figure 8B:
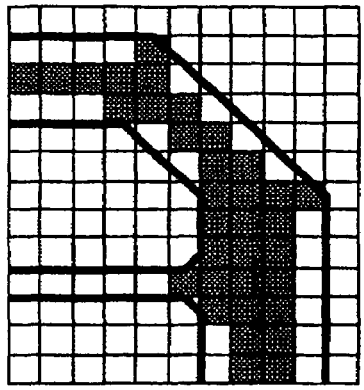
FIG. 8(B) is an explanatory diagram illustrating an internal image.
Figure 8C:
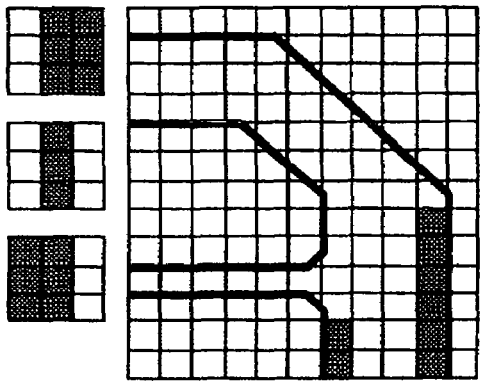
FIG. 8(C) is an explanatory diagram illustrating a 0-degree edge image.
Figure 8D:
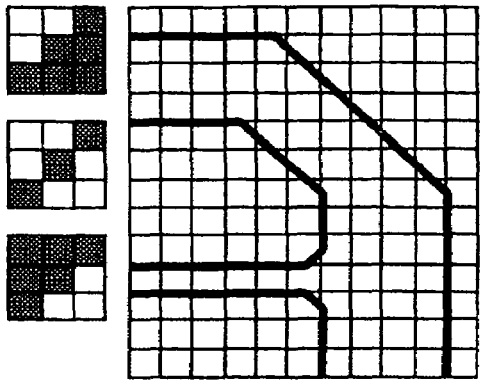
FIG. 8(D) is an explanatory diagram illustrating a 45-degree edge image.
Figure 8E:
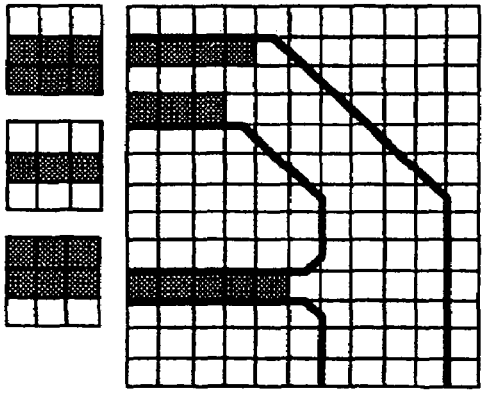
FIG. 8(E) is an explanatory diagram illustrating a 90-degree edge image.
Figure 8F:
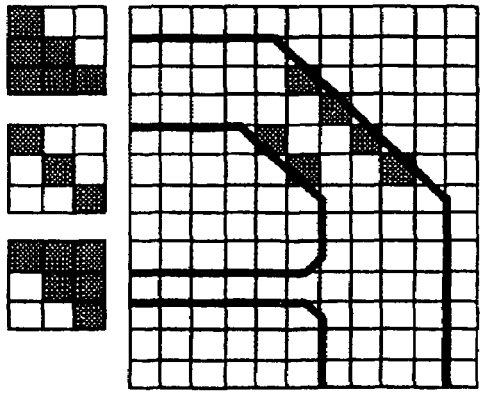
FIG. 8(F) is an explanatory diagram illustrating a 130-degree edge image.

While the edge image may be a curved line when the coating image is complex, normally the edges can be represented by a combination of numerous straight lines. In the preferred embodiment, an edge image is represented by the four angles 0 degrees, 45 degrees, 90 degrees, and 135 degrees in clockwise order, where 0 degrees is a vertical line in the graph (Y-direction in FIG. 3). In the coating image of FIG. 8(A), a 45-degree edge image of FIG. 8(D) does not exist. Therefore, the 0-degree edge image of FIG. 8(C), the 90-degree edge image of FIG. 8(E), and the 135-degree edge image of FIG. 8(F) are extracted. The internal image of FIG. 8(B) indicates the image remaining after subtracting the edge images of FIGS. 8(C), 8(E), and 8(F) from the coating image of FIG. 8(A).

While the preferred embodiment uses template matching to extract images from the image, another method known in the art may also be used. Simple templates of edge images used in the preferred embodiment are shown on the left side of the edge images in FIGS. 8(C)-8(F). By increasing the number of templates, it is possible to extract edge images having other angles. However, to simplify the inkjet coater, it is preferable to extract only edge images having angles for which precision coating is desirable.

After the desired coating image has been sorted into edge images with different angles and a single internal image in this way, the inkjet coater 1 first coats each edge image and subsequently coats the internal image.

Next, steps in the process of coating edge images will be described with reference to FIG. 3, FIG. 8 and FIG. 9. Edge coating involves three steps, including (a) an operation to adjust the edge angle (direction), (b) an operation to adjust the nozzle position, and (c) an operation to form the edges.

First, (a) the operation to adjust the edge angle is performed to align the orientation of the edge with the direction in which the translation stage 104 is conveyed (y-direction in FIG. 3). In this step, the substrate 112 is placed on the rotating stage 105 by a robot or the like (not shown), and a position detecting device (not shown) reads marks or the like (not shown) that have been printed in the four corners of the substrate 112. As long as the marks or the like are not in a prescribed position, the substrate 112 is rotated to each angle of the edge image, enabling the orientation of the edge in the edge image on the substrate 112 to be aligned accurately with the conveying direction of the translation stage 104 (y-direction).

FIG. 9 illustrates this operation of rotating the substrate 112 to each edge angle. By rotating the edge image in FIGS. 8(C), 8(E), and 8(F) by their corresponding angle, the substrate 112 is oriented as shown in FIGS. 9(A), 9(B), and 9(C), respectively. Since an edge image of 45 degrees shown in FIG. 8(D) has not been extracted in the present example, a coating operation is not performed at this angle.

Next, (b) the operation for adjusting nozzle positions is performed for aligning the position of each nozzle along each scan line of the rotated edge image.

This operation is performed by rotating the rotating head 106 and moving each of the nozzle modules 110 parallel to one another in the longitudinal direction thereof. For example, the pitch of the nozzle holes 201 in the x-direction must be 0.1 mm or an integral fraction thereof in order to coat the 0-degree edge image of FIG. 9(A) with ink along scan lines 401 (an interval of 0.1 mm, equivalent to the pixel size).

A nozzle position adjustment operation is unnecessary when the pitch of the nozzle holes 201 is 0.1 mm or an integral fraction thereof. When a nozzle is disposed between each scan line 401, in other words, the pitch of the nozzle holes 201 is 0.1 mm or an integral fraction thereof, ink need not be ejected from nozzles between the scan lines 401.

When the pitch of the nozzle holes 201 does not meet the condition described above, the operation for adjusting the nozzle positions is performed by sliding the four nozzle modules 110 at regular intervals using the actuators 107. Since the nozzle holes 201 of all nozzle modules 110 are arranged at equal intervals in the x-direction through this operation, the nozzle position adjusting operation is completed when the pitch of all nozzle holes 201 in the x-direction is 0.1 mm or an integral fraction thereof.

On the other hand, if the pitch of the nozzle holes 201 in the x-direction is not 0.1 mm or an integral fraction thereof, even after sliding the nozzle modules 110, the rotating head 106 must be rotated. Since there are four nozzle modules 110 in the preferred embodiment, the pitch of the nozzle holes 201 in each nozzle module 110 in the x-direction should be 0.1×4=0.4 mm in order that the pitch of the nozzle holes 201 in the x-direction are 0.1 mm. Since the real pitch of the nozzle holes 201 in each nozzle module 110 is 0.5 mm, an angle θ at which the rotating head 106 should be rotated is as follows:

$$\cos\theta - 0.4/0.5(\theta=36.9) \quad (1)$$

Next, the four nozzle modules 110 are slid until all nozzle holes 201 are arranged at regular intervals in the x-direction. If there is no rotation, the nozzle modules 110 can be slid 0.5/4=0.125 mm in order to arrange all nozzle holes 201 at regular intervals in the x-direction. However, if there is rotation, the offset caused by this rotation must be taken into account. If the interval between the nozzle modules 110 is Dm (mm), then distances S12, S13, and S14 (mm) for sliding each of the nozzle modules 110 with reference to the bottommost nozzle module 110 in FIG. 3 are calculated as follows:

$$S12=0.125+Dm\tan\theta \quad (2)$$

$$S13-2\times S12 \quad (3)$$

$$S14=3\times S12 \quad (4)$$

If the pitch of the targeted scan lines is greater than 0.1 mm, then it is possible to reduce the number of nozzle modules 110 being used from four to three or to skip over some of the nozzle holes 201 used for ejection.

Next, (c) the edge image forming operation is performed to coat edges at the prescribed pitch in the y-direction.

This operation will be described with reference to FIGS. 9(A)-9(C). As in the prior art, ink droplets are ejected through the nozzle holes 201 at a timing at which the substrate 112 carried on the translation stage 104 in the y-direction passes beneath the rotating head 106.

By rotating the nozzle modules 110 at this time, the nozzle holes 201 become offset from one another in the y-direction Therefore, the timing of nozzle ejections must be adjusted to achieve a desired ejection position. For example, it a certain nozzle hole 201 is offset 1 cm in the y-direction from its intended position through this rotation, a control process is performed to offset the ejection timing by 1 cm.

However, the piezoelectric element driver 109 of the preferred embodiment employs a method of applying the drive voltage Vd to all nozzles commonly. Since this method requires only a single analog drive source (the drive voltage waveform generator 302 in the preferred embodiment), the multiple nozzle head can be implemented with an extremely simple construction. On the other hand, since the drive voltage Vd is applied to all nozzles commonly, the ejection timing follows the timing at the latch clock LCK, as shown in FIG. 7. Therefore, this method does not allow fine adjustments to the ejection timing for each nozzle In the example shown in FIG. 10, the nozzle holes 201 disposed at points n1, n2, n3, and n4 on the x-axis move to points n1', n2', n3', and n4' when the respective nozzle module 110 rotates. The ejection timing for each nozzle hole 201 is offset in order to eject ink onto the x-axis.

However, since the ejection timing is synchronized with the latch clock LCK timing (timings T1, T2, T3, T4, and T5 in FIG. 10), the nozzle holes 201 can only eject ink at the timings T1, T2, T3, T4, and T5. Therefore, ink droplets land at points P1, P2, P3, and P4 when ejected from each nozzle hole 201 at the timing nearest the x-axis (T1 for n1', T2 for n2', T4 for n3', and T5 for n4'). Accordingly, it is difficult to eject ink from all of the nozzle holes 201 onto the x-axis.

However, the inkjet coater of the preferred embodiment coats a workpiece at twice the resolution in the scanning direction (y-direction in FIG. 3). By doubling the timing of the latch clock LCK, the frequency at which ink can be ejected from the nozzle holes 201 doubles. On the other hand, the weight of ejected droplets also lessens due to a drop in the voltage amplitude of the drive voltage Vd shown in FIG. 7.

Figure 9A:
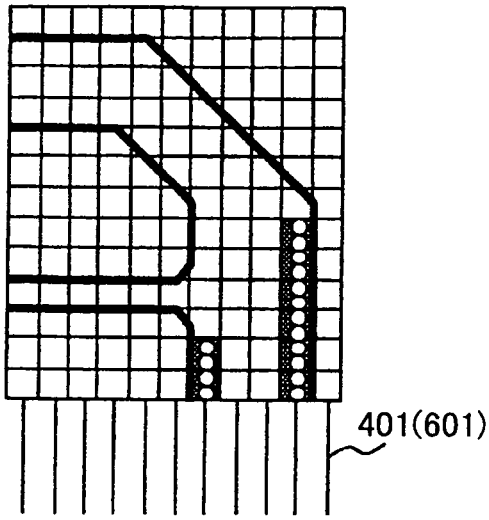
FIG. 9(A) is an explanatory diagram illustrating processes of coating the edge image shown in FIG. 8(C)
Figure 9B:
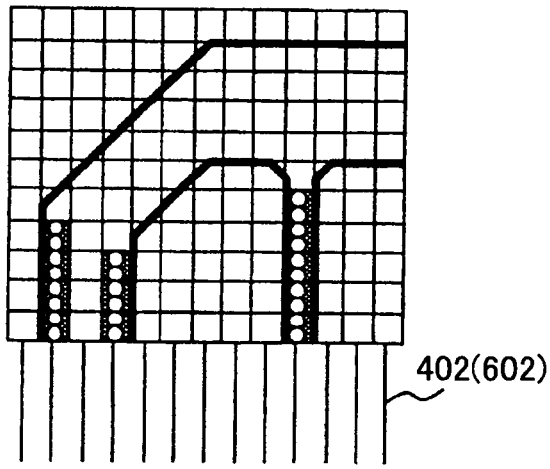
FIG. 9(B) is an explanatory diagram illustrating processes of coating the edge image shown in FIG. 8(E)
Figure 9C:
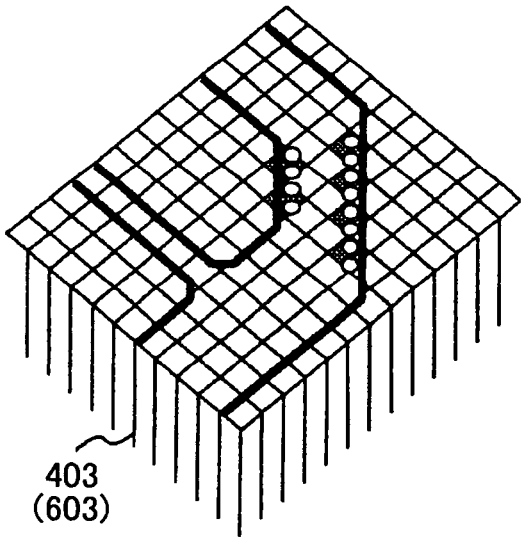
FIG. 9(C) is an explanatory diagram illustrating processes of coating the edge image shown in FIG. 8(F)

In this way, the edge image is effectively coated at twice the resolution in the y-direction, as shown in FIGS. 9(A)-9(C). These lines are thinner when coated under conventional ejection conditions. Since the amount of liquid vaporization is proportional to the surface area, edge images formed with smaller droplets, dry very quickly and, hence, reduce ink spreading. Further, since the edge images are recorded with a single nozzle, ink can be ejected at precise locations without distortion or jitter caused by variations in ejection speed and droplet weight among different nozzles.

For the 90-degree edge image shown in FIG. 9(B), the rotating stage 105 rotates the substrate 112 90 degrees clockwise. Subsequently, the nozzle modules 110 are rotated and slid to match the pitch of scan lines 402, and the edges are coated at twice the resolution. The pitch of the scan lines is 0.1 mm, identical to that for the 0-degree edge image shown in FIG. 9(A).

For the 135-degree edge image shown in FIG. 9(C), the rotating stage 105 rotates the substrate 112 135 degrees clockwise. Next, the rotating head 106 is rotated to match the pitch of scan lines 403. Since the pitch of the scan lines 403 is $0.1/\sqrt{2}$, the rotational angle θ is as follows:

$$\cos\theta=0.1/(\sqrt{2}\times0.125)\ (\theta\times55.6) \tag{5}$$

Next, the slide distances S12, S13, and S14 for each of the nozzle modules 110 is found from equations (2)-(4), and the nozzle modules 110 are slid to match the pitch of the scan lines 403. The lines shown in FIG. 9(C) are coated at twice the resolution.

After completing the above edge image coating operation, the internal image coating operation is performed to coat the remaining internal image on the substrate 112.

Figure 9D:
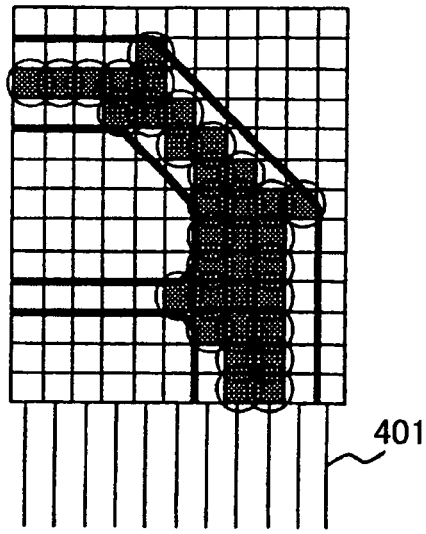
FIG. 9(D) is an explanatory diagram illustrating processes of coating the internal image shown in FIG. 8(B)
Figure 10:
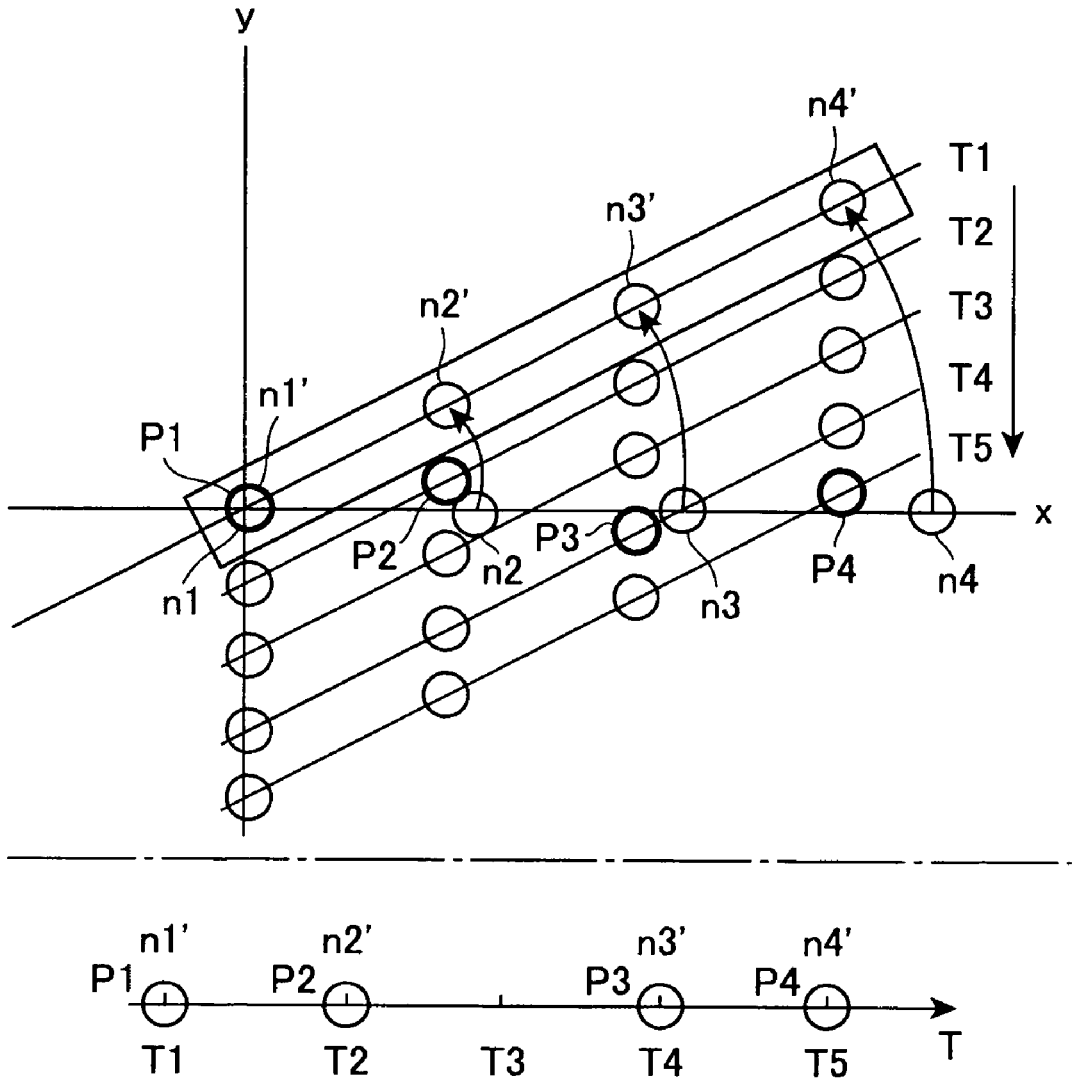
FIG. 10 is an explanation diagram illustrating the movement of the nozzle holes.

The internal image coating operation will be described with reference to FIG. 9(D). FIG. 9(D) illustrates the operation for coating the internal image shown in FIG. 8(B). It is preferable to perform the internal image coating operation after the edge images have dried.

Before performing this operation, the substrate 112 and rotating head 106 are rotated, and the nozzle modules 110 are returned to the state for the 0-degree edge image shown in FIG. 9(A). By using the leveling technique for the internal image coating operation, the internal image can be coated at the same resolution and ejection weight described in the prior art. The ink droplets ejected in this coating operation expand on the substrate 112 and blend with the is edge images. Since the surface area of ink is small with respect to weight, little heat is emitted, and the leveling effects are realized. Hence, this process reduces variations in ejection weights from each nozzle and variations in ejection positions, thereby forming a thin film at a precise thickness. Further, the ink in the internal image is restricted from spreading at the edges by the already dried edge image, thereby maintaining a sharp coated image at the edge portions.

Since the inkjet coating apparatus 1 in the first embodiment first forms the edge images, the apparatus has the flexibility of forming edge images, for example, narrow lines with microdroplets, thereby dry the edge images quickly, suppressing the spreading of ink on the substrate and recording edges at precise positions. Subsequently, the internal image is recorded with normal droplets that spread. Hence, the coating thickness in the internal image can be precisely controlled through the leveling effect. Moreover, the precise positions of the edges can be maintained since ink near the edge images spreads in a direction that follows the already coated edges.

In addition, according to the inkjet coating apparatus 1 in the first embodiment, an edge image extending to a direction is coated by moving the coating head along the edge, thereby continuously recording the edge with a single nozzle. Hence, jitter or the like caused by variations between nozzles does not occur. Moreover, since the edges are recorded continuously, the recording state does not change during edge formation, avoiding variations in ink weight and ejection position.

As a result, the inkjet coating apparatus 1 in the first embodiment can achieve high-performance coating with a simple system by forming a precise coating over the inner area of the coating region and a precise coating on the peripheral parts.

Next, an inkjet coater according to a second embodiment of the present invention will be described with reference to FIGS. 11 and 12.

Figure 11:
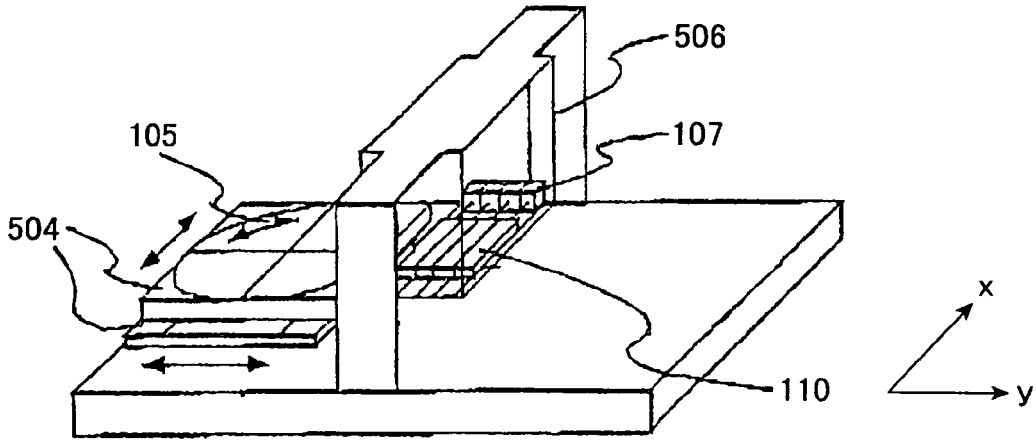
FIG. 11 is a perspective view showing an inkjet coater according to a second embodiment.
Figure 12:
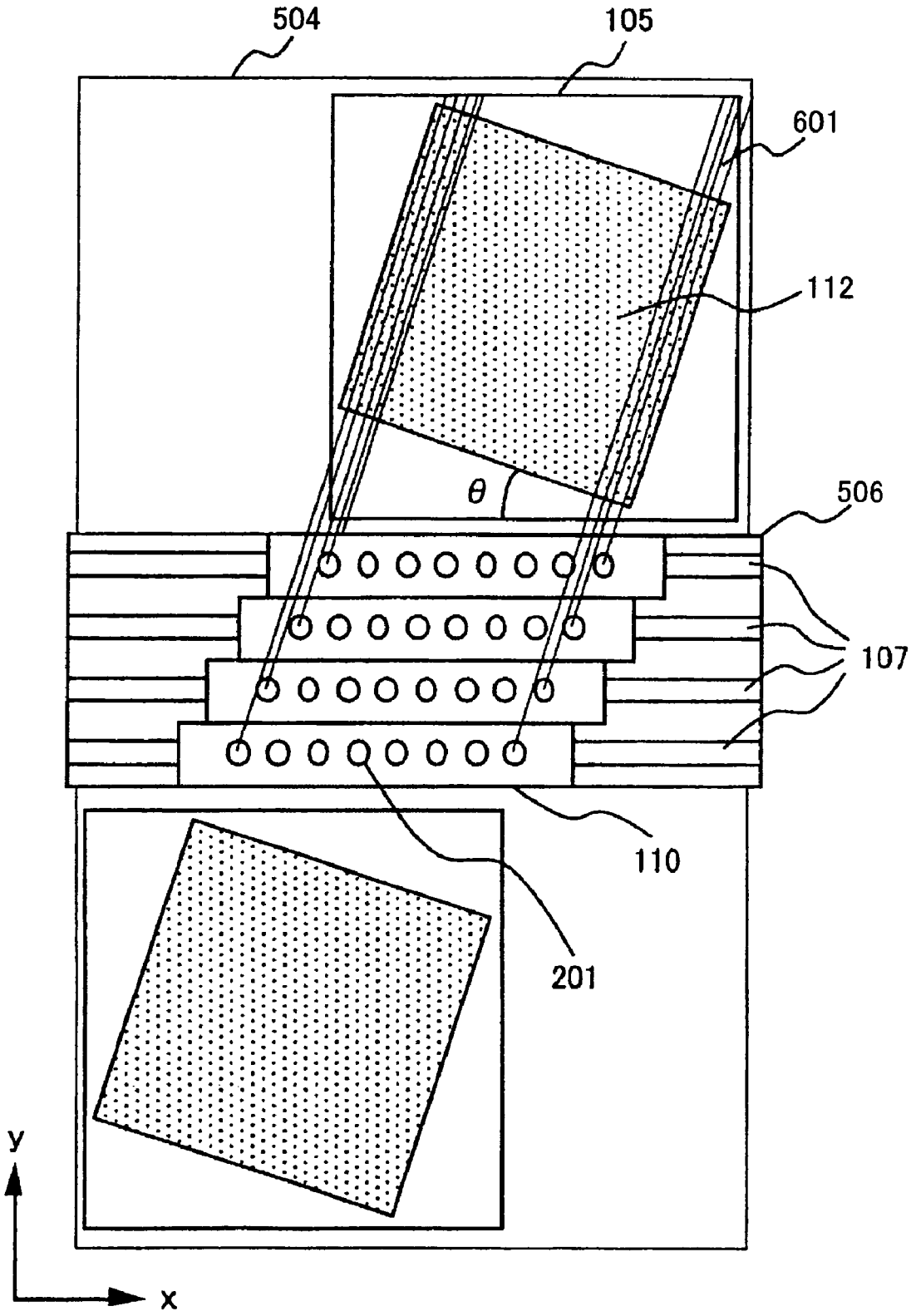
FIG. 12 is a plan view of the inkjet coater according to the second embodiment.

FIG. 11 is a perspective view showing the general structure of the inkjet coater according to the second embodiment. FIG. 12 is a plan view showing the general structure of the inkjet coater. While the rotating head 106 described in the first embodiment has a rotation function, the rotating head 106 is rotated on top of the substrate 112 and, hence, there is a danger that duet or the like will collect on top of the rotating stage 105.

For this reason, an x-y stage 504 capable of moving in both the x- and y-directions is employed in the second embodiment in place of the translation stage 104 capable of moving only in the y-direction used in the first embodiment, and the substrate 112 is rotated by the rotating stage 105 rather than the rotating head 106. Therefore, there is no need to provide the head rotating unit 111 in the second embodiment.

Next, steps in the process of coating edge images will be described with reference to FIG. 9 and FIG. 12. Edge coating involves three steps, including (a) an operation to adjust the edge angle (direction), (b) an operation to adjust the nozzle position, and (c) an operation to form the edges. In the second embodiment, (a) an operation to adjust the edge angle and (c) an operation to form the edges are the same as those described in the first embodiment. Accordingly, (b) the operation to adjust the nozzle position in order to align the positions or each nozzle with scan lines 601 will be described bellow.

First, an operation for coating the 0-degree edge image shown in FIG. 9(A) will be described. At the beginning of this operation, the rotating stage 105 is rotated an angle θ in the clockwise direction. The angle θ is the same as those shown in equations (1). Thus, the scan lines 601 slants the angle θ as shown in FIG. 12. Next, the four nozzle modules 110 are moved parallel to one another so that the nozzle holes pass over the slanted scan lines 601. More specifically, the nozzle holes 201 of the bottommost nozzle module 110 in the drawing are arranged to pass over reference scan lines using x-directional movement of the bottommost nozzle module 110 and/or y-directional movement of the x-y stage 504. Subsequently, the remaining nozzle modules 110 are slid the distances S12, S13, and S14 with respect to the bottommost nozzle module 110 so that all of the nozzle holes 201 pass over the scan lines 601. The sliding distances S12, S13, and S14 are the same as those shown in equations (2)-(4).

Next, the 0-degree edge image is coated over the substrate 112 at the specified pitch in the scanning direction. In the second embodiment, intervals between nozzle holes 201 are matched the pitch of the scan lines 601 by slanting the scan lines along the scanning direction rather than rotating the head 506. Subsequently, the x-y stage 504 is used to move the substrate 112 in the slanted scanning direction. Ink ejection is controlled while moving the substrate 112 from the upper right in FIG. 12 toward the lower left.

Next, (c) the operation for forming the 90-degree edge image shown in FIG. 9(B) will be described. For this operation, the substrate 112 is rotated 90-degrees counterclockwise from the angle θ shown in FIG. 12. Here, the rotating stage 105 is controlled to rotate the substrate 112 counterclockwise to achieve a 90-degree rotation. The pitch of scan lines 602 is the same as the pitch of scan lines 601 in the 0-degree edge image of FIG. 9(A), and the subsequent operations are the same as those described in the first embodiment.

Next, an operation for coating the 135-degree edge image shown in FIG. 9(C) will be described. Here, the pitch of scan lines 603 is less than the pitch of scan lines 601 for the 0-degree edge image of FIG. 9(A). Accordingly, the substrate 112 is first rotated to an angle θ 2 and subsequently rotated counterclockwise 135 degrees. The rotational angle θ 2 is found from equation (5). All subsequent operations, including coating of the internal image, are the same as those described in the first embodiment.

Since it is unnecessary to rotate the head 506 in the second embodiment, there is little chance for dust and the like to collect on the substrate 112. If the slope θ is large, the x-y stage 504 must be moved a great distance in the x-direction. In such a case, a large stage may be used.

While the invention has been described in detail with reference to the specific embodiments thereof, it would be apparent to those skilled in the art that various changes and modifications may be made therein without departing from the spirit of the invention.

What is claimed is:

1. An inkjet coating method for forming a coating image on a substrate by ejecting ink droplets from a plurality of nozzles formed in a head, the head having a head-surface on which the plurality of nozzles are exposed, the substrate having a substrate-surface onto which the ink droplets are ejected, the head-surface being oriented parallel to the substrate-surface, the coating image being formed, while moving either the substrate or the head, or both, in a moving-direction and placing the head-surface and the substrate-surface in confronting relation, wherein the coating image is formed from an edge image defining an outline of the coating image, and an internal image within the edge image, the method comprising:

extracting edge image data indicative of the edge image from image data indicative of the coating image;

adjusting a pitch of said nozzles, the pitch being a spacing between adjacent nozzles viewed from a projection in said moving direction, wherein said adjusting a pitch includes moving a first plurality of said nozzles a displacement distance along a linear axis relative to a second plurality of said nozzles, the displacement distance being in accordance with said pitch;

forming an edge image on the substrate based on the edge image data, the edge image forming including forming an edge image portion extending in the moving-direction by continuously ejecting the ink droplets from a single nozzle onto the substrate, while moving either the substrate or the head, or both, in the moving-direction; and forming an internal image on the substrate after forming the edge image.

2. The inkjet coating method according to claim 1, wherein the edge image data includes a plurality of pieces of edge portion image data each indicative of each of the plurality of edge image portions making up the edge image, and the extracting extracts, from the image data, the plurality of piece of edge portion image data.

3. The inkjet coating method according to claim 1, wherein the edge image forming comprises forming the plurality of edge portion images extending in a same direction.

4. The inkjet coating method according to claim 2, further comprising a direction adjusting that, after the extracting and before executing the edge image forming, adjusts a direction to which an edge image portion extends so as to be in coincidence with the moving-direction, while rotating either the substrate or the head in a rotating-plane oriented parallel to the head-surface and the substrate-surface.

5. The inkjet coating method according to claim 3, wherein the internal image forming comprises a forming of the internal image after forming the edge image by executing the direction adjusting and the edge image forming with respect to all the edge portion images.

6. The inkjet coating method according to claim 2, further comprising:

a direction adjusting that, after executing the extracting and before executing the edge image forming, adjusts a direction to which an edge image portion extends so as to be in coincidence with the moving-direction, while rotating only the substrate in a rotating-plane oriented parallel to the head-surface and the substrate-surface.

7. The inkjet coating method according to claim 6, wherein the head has a plurality of nozzle modules, including a first nozzle module having the first plurality of nozzles and a second nozzle module having the second plurality of nozzles, and the adjusting a pitch includes moving the relative position of the first and second nozzle modules along the linear axis.

8. The inkjet coating method according to claim 7, wherein the nozzle pitch adjusting moves comprises the relative positions of the plurality of nozzle modules along the linear axis so that all the nozzles align at an equi-interval pitch as viewed from the moving-direction.

9. The inkjet coating method according to claim 1, wherein the internal image forming comprises a forming of the internal image after the edge image formed with the ink droplets have dried.

10. The inkjet coating method according to claim 1, wherein the forming the internal image comprises ejecting the ink droplets at an equi-interval and at an ejected amount such that the ink droplets expand on the substrate and blend with each other.

11. The inkjet coating method according to claim 1, wherein the forming the internal image includes an ejecting of ink droplets and wherein the forming the edge image and the forming the internal image are such that an ejected amount for each ink droplet forming the edge image is smaller than an amount for each ink droplet forming the internal image.

12. The inkjet coating method according to claim 1, wherein the forming the internal image includes an ejecting of ink droplets and wherein the forming the edge image and the forming the internal image are such that the ink droplets for forming the edge image are ejected at an equi-interval which is smaller than an equi-interval of the ink droplets ejected for forming the internal image.

13. An inkjet coating apparatus comprising:

a head having a head-surface on which a plurality of nozzles are exposed, the head supporting a plurality of nozzle modules, each supporting a respective plurality of said nozzles, wherein the head includes a nozzle pitch adjusting means for adjusting a pitch between adjacent nozzles viewed from a projection in a moving direction, wherein said nozzle pitch adjusting means includes means for moving at least one of a first nozzle module of said nozzle modules and a second nozzle module of said nozzle modules, in a direction parallel to a linear axis, to selectively set an offset distance along the linear axis between the first nozzle module and second nozzle module, wherein said first and second nozzle modules are arranged such that the pitch is based, at least in part, on the selectable offset position;

a substrate having a substrate-surface onto which ink droplets are ejected, the head-surface being oriented parallel to the substrate-surface, wherein a coating image is formed from an edge image defining an outline of the coating image, and an internal image within the edge image;

a moving unit for moving either the head or the substrate, or both, in the moving-direction and placing the head-surface and the substrate-surface in confronting relation;

an extracting unit for extracting edge image data indicative of the edge image from image data indicative of the coating image;

an edge image forming unit for forming the edge image including an edge image portion extending in the moving-direction by continuously ejecting the ink droplets from a single nozzle onto the substrate, while moving either the substrate or the head, or both, in the moving direction; and an internal image forming unit for forming the internal image on the substrate.

14. The inkjet coating apparatus according to claim 13, wherein the edge image data includes a plurality of pieces of edge portion image data each indicative of each of the plurality of edge image portions making up the edge image, and the extracting unit extracts the plurality of piece of edge portion image data from the image data.

15. The inkjet coating apparatus according to claim 14, further comprising a direction adjusting unit for adjusting a direction to which an edge image portion extends so as to be in coincidence with the moving-direction, while rotating the substrate in a rotating-plane oriented parallel to the head-surface and the substrate-surface.

16. The inkjet coating apparatus according to claim 15, further comprising a nozzle adjusting unit for adjusting a position of the single nozzle so that the ink droplets ejected from the single nozzle forms the edge portion image, while moving the head.

17. The inkjet coating apparatus according to claim 16, wherein the nozzle adjusting unit adjusts the relative positions of the plurality of nozzle modules along the linear axis so that all the nozzle in the plurality of the nozzle modules align at an equi-interval pitch as viewed from the moving-direction.

18. The inkjet coating apparatus according to claim 13, wherein the internal image forming unit ejects the ink droplets at an equi-interval with an ejecting amount so that the ink droplets expand on the substrate and blend with each other.

19. The inkjet coating apparatus according to claim 13, wherein the edge image forming unit and the internal image forming unit are arranged such that an amount for each ink droplets forming the edge image is smaller than an amount for each ink droplets forming the internal image.

20. The inkjet coating apparatus according to claim 13, wherein the edge image forming unit and the internal image forming unit are arranged such that the ink droplets for forming the edge image are ejected at an equi-interval which is smaller than an equi-interval of the ink droplets ejected for forming the internal image.

21. The method of claim 1, wherein the adjusting further includes moving a third plurality of said nozzles a second displacement distance along the linear axis, the second displacement distance being approximately double the displacement distance of the first plurality of nozzles, and moving a fourth plurality of said nozzles a third displacement distance along the linear axis, the third displacement distance being approximately three times the displacement distance of the first plurality of nozzles.

22. The method of claim 1, wherein the adjusting further includes rotating the head about a pivot axis to arrange said linear axis given angle with respect to the movement direction, and wherein said pitch is further based on said given angle.

23. The inkjet coating apparatus of claim 13, wherein said nozzle pitch adjusting means further includes means for moving a third nozzle module of said nozzle modules in the direction parallel to the linear axis to another selectable position along the linear axis, and means for moving a fourth nozzle module of said nozzle modules in the direction parallel to the linear axis to another selectable position along the linear axis, and wherein the pitch is based, at least in part, respective positions along the linear axis of the first module, the second module, the third module, and the fourth module.

24. The inkjet coating apparatus of claim 1, wherein the adjusting means further includes means for rotating the head about a pivot axis to arrange said linear axis given angle with respect to the movement direction, and wherein head is arranged with respect to said movement direction wherein said pitch is further based on said given angle.

* * * * *